US012643650B1

(12) United States Patent
Snyder et al.

(10) Patent No.: US 12,643,650 B1
(45) Date of Patent: Jun. 2, 2026

(54) ACTUATION SYSTEM ON A MARINE VESSEL AND CONFIGURATION METHOD THEREFOR

(71) Applicant: Brunswick Corporation, Mettawa, IL (US)

(72) Inventors: Matthew W. Snyder, Fond du Lac, WI (US); Aaron J. Ward, Oshkosh, WI (US); Phillips L. Munter, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 210 days.

(21) Appl. No.: 18/739,601

(22) Filed: Jun. 11, 2024

(51) Int. Cl.
*B63H 25/42* (2006.01)
*B63H 25/04* (2006.01)

(52) U.S. Cl.
CPC ..... *B63H 25/42* (2013.01); *B63H 25/04* (2013.01)

(58) Field of Classification Search
CPC ..... B63H 25/42; B63H 25/04
See application file for complete search history.

(56) References Cited

U.S. PATENT DOCUMENTS 7,699,674 B1 4/2010 Wald
8,113,892 B1 2/2012 Gable
9,278,740 B1 3/2016 Andrasko
10,112,688 B1 10/2018 Hartman et al.
10,829,190 B1 11/2020 Pugh
11,780,549 B1 10/2023 Faust

OTHER PUBLICATIONS

Lenco Marine Inc., "Extreme Duty Performance Trim Tab Kits," pp. 16-17 of product catalog, admitted prior art, available at https://pdf.nauticexpo.com/pdf/lenco-marine/lenco-marine-products-catalog/23596-28246.html, last accessed Jun. 9, 2023.

*Primary Examiner* — Brodie J Follman

(74) *Attorney, Agent, or Firm* — Andrus Intellectual Property Law, LLP

(57) ABSTRACT

An actuation system for moving at least two devices on a marine vessel includes at least three actuators, wherein the at least three actuators include at least one pair of actuators configured to jointly move a first actuated device, a plurality of position sensors configured to generate position information indicating whether each one of the at least three actuators has moved and/or whether the first actuated device has moved, and a controller configured to control each of the at least three actuators, wherein locations of the at least three actuators are initially unknown by the controller, and wherein the controller is configured to automatically determine the location of each of the at least three actuators on the marine vessel based on the position information measured in response to movement commands and, thereafter, control each of the at least three actuators based on their respective location.

20 Claims, 6 Drawing Sheets

ACTUATION SYSTEM ON A MARINE VESSEL AND CONFIGURATION METHOD THEREFOR

FIELD

The present disclosure relates to systems and methods for configuring an actuation system on a marine vessel, and more particularly to determining the locations of at least three actuators arranged in at least one pair of actuators configured to jointly move an actuated device on a marine vessel.

BACKGROUND

The following U.S. patents are incorporated herein by reference, in entirety:

U.S. Pat. No. 7,699,674 discloses a steering mechanism connects the shaft of an actuator with a piston rod of a hydraulic cylinder and provides a spool valve in which the spool valve housing is attached to the hydraulic cylinder and the shaft of the actuator extends through a cylindrical opening in a spool of the spool valve. The connector is connectable to a steering arm of a marine propulsion device and the spool valve housing is connectable to a transom of a marine vessel.

U.S. Pat. No. 8,113,892 discloses a marine propulsion control system receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 9,278,740 discloses a system for controlling an attitude of a marine vessel having first and second trim tabs includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 10,829,190 discloses a trim control system for controlling a relative position of a trimmable marine device with respect to a marine vessel hull includes a trim actuator coupled to the trimmable marine device about a horizontal trim axis. The trim control system further includes a trim control module executable on a processor and configured to identify a target trim position for the trimmable marine device, determine a desired trim rate of change to rotate the trimmable marine device about the horizontal axis from a current trim position toward a target trim position, and operate the trim actuator to rotate the trimmable marine device at the desired trim rate of change toward the target trim position.

U.S. Pat. No. 11,780,549 discloses a cowling is for a marine drive. The cowling has first and second cowl portions for enclosing a powerhead, and a latching device which is movable into a latched position in which the powerhead is enclosed by the first cowl and second cowl portions and an unlatched position in which the second cowl portion is movable with respect to the first cowl portion so that the powerhead is accessible. The latching device has an electric actuator configured to automatically move the latching device from the latched position to the unlatched position and a manually-operable input device which is accessible from outside of the cowling and is configured to actuate the electric actuator to thereby automatically move the latching device from the latched position to the unlatched position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect of the present disclosure, an actuation system for moving at least two devices on a marine vessel includes at least three actuators, wherein the at least three actuators includes at least one pair of actuators configured to jointly move a first actuated device, and a plurality of position sensors configured to generate position information indicating whether each one of the at least three actuators has moved and/or whether the first actuated device has moved. A controller is configured to control each of the at least three actuators, wherein locations of the at least three actuators are initially unknown by the controller, and wherein the controller is configured to automatically determine the location of each of the at least three actuators on the marine vessel based on the position information measured in response to movement commands. Thereafter, the controller controls each of the at least three actuators based on their respective location.

In one embodiment, the first actuated device is a trim tab.

In another embodiment, the first actuated device is a steerable marine drive or a trimmable marine drive.

In another embodiment, the pair of actuators is configured such that the first actuated device does not move unless both actuators in the pair of actuators receive a movement command. Optionally, each actuator in the pair of actuators is configured to prevent movement when no movement command is received.

In another embodiment, the controller is configured to automatically select two of the at least three actuators, send a movement command to each of the selected two actuators, and assign an actuator location to each of the at least three actuators based on the position information measured by the plurality of position sensors in response to the movement commands.

In another embodiment, the controller is further configured to, determine whether at least one of the selected two actuators by at least a threshold actuator movement or the first actuated device moved by at least a threshold device movement in response to the movement command based on the position information, and assign the actuator location to each of the at least three actuators based on whether at least one of the selected two actuators moved by at least the threshold actuator movement and/or the first actuated device moved by at least the threshold device movement in response to the movement command.

In another embodiment, the pair of actuators is configured such that the first actuated device does not move unless both actuators in the pair of actuators receive a movement command.

In another embodiment, the system further includes at least three position sensors, including a position sensor associated with each of the at least three actuators and configured to generate position information indicating whether a respective one of the at least three actuators moved by at least a threshold actuator movement, and wherein the controller is configured to assign the location to each of the at least three actuators based on which of a selected two actuators moves in response to a movement command.

In another embodiment, the system further includes at least four actuators, wherein a first pair of actuators is configured to jointly move the first actuated device and wherein the first pair of actuators is configured such that the first actuated device does not move unless both actuators in the first pair of actuators receive a movement command, and further includes a second pair of actuators configured to jointly move a second actuated device, wherein the second pair of actuators is configured such that the second actuated device does not move unless both actuators in the second pair of actuators receive the movement command, wherein the controller is configured to automatically determine the location of each of the at least four actuators by determining which of the at least four actuators is in the first pair and which of the at least four actuators is in the second pair.

In another embodiment, the controller is further configured to automatically select a first actuator and a second actuator from the at least four actuators, send a first movement command to each of the first actuator and the second actuator, following the first movement commands, receive first position information from a first position sensor associated with the first actuator and second position information from a second position sensor associated with the second actuator, and assign an actuator location to each of the at least four actuators based on the first position information and the second position information.

In another embodiment, the controller is configured to assign an actuator location to each of the at least four actuators based on whether neither the first actuator nor the second actuator moved by at least a threshold actuator movement or both the first actuator and the second actuator moved by at least the threshold actuator movement.

In another embodiment, the controller is configured to, in response to determining that neither the first actuator nor the second actuator moved by at least the threshold actuator movement, automatically select a third actuator from the at least four actuators and send a second movement command to each of the first actuator and a third actuator and assign an actuator location to each of the at least four actuators based on the first position information and the second position information measured in response to the second movement command.

In another embodiment, the controller is configured to, in response to determining that both the first actuator and the second actuator moved by at least the threshold actuator movement in response to the movement commands, assign the first actuator and the second actuator as being either the first pair of actuators configured to actuate the first actuated device or the second pair of actuators configured to actuate the second actuated device.

In another aspect of the present disclosure, a method of configuring an actuation system on a marine vessel, wherein the actuation system comprises at least three actuators arranged in at least one pair of actuators configured to jointly move a first actuated device, wherein locations of the at least three actuators are initially unknown by a controller, includes the controller automatically determining the locations of the at least three actuators by selecting two of the at least three actuators, sending a movement command to each of the selected two actuators, and assigning an actuator location to each of the at least three actuators based on position information measured by a plurality of position sensors in response to the movement commands.

In one embodiment, assigning the actuator location to each of the at least three actuators includes determining whether at least one of the selected two actuators or the first actuated device moved by at least a threshold device movement in response to the movement command based on the position information measured by a plurality of position sensors.

In another embodiment, the pair of actuators is configured such that the first actuated device does not move unless both actuators in the pair of actuators receive a movement command.

In another embodiment, the first actuated device is a trim tab, a steerable marine drive, or a trimmable marine drive.

In another embodiment, the actuation system further includes at least four actuators including a first pair of actuators and a second pair of actuators, wherein the first pair of actuators is configured to jointly move the first actuated device and wherein the first pair of actuators is configured such that the first actuated device does not move unless each actuator in the first pair of actuators receives a movement command, and the second pair of actuators configured to jointly move a second actuated device, wherein the second pair of actuators is configured such that the second actuated device does not move unless each actuator in the second pair of actuators receives the movement command. The method further comprises automatically determining, with the controller, the location of each of the at least four actuators by determining which of the at least four actuators is in the first pair and which of the at least four actuators is in the second pair.

In another embodiment, the method further includes automatically selecting a first actuator and a second actuator from the at least four actuators, sending a first movement command to each of the first actuator and the second actuator, following the first movement commands, receiving first position information from a first position sensor associated with the first actuator and second position information from a second position sensor associated with the second actuator, and assigning an actuator location to each of the at least four actuators based on the first position information and the second position information.

In another embodiment, the method further includes determining whether neither the first actuator moved or both the first actuator and the second actuator moved by at least a threshold actuator movement, in response to determining that neither the first actuator nor the second actuator moved by at least the threshold actuator movement, automatically selecting a third actuator from the at least four actuators and sending a second movement command to each of the first actuator and a third actuator and assigning an actuator location to each of the at least four actuators based on the first position information and the second position information measured in response to the second movement command, and in response to determining that both the first actuator and the second actuator moved by at least the threshold actuator movement in response to the movement commands, assigning the first actuator and the second actuator as being either the first pair of actuators configured to actuate the first actuated device or the second pair of actuators configured to actuate the second actuated device.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
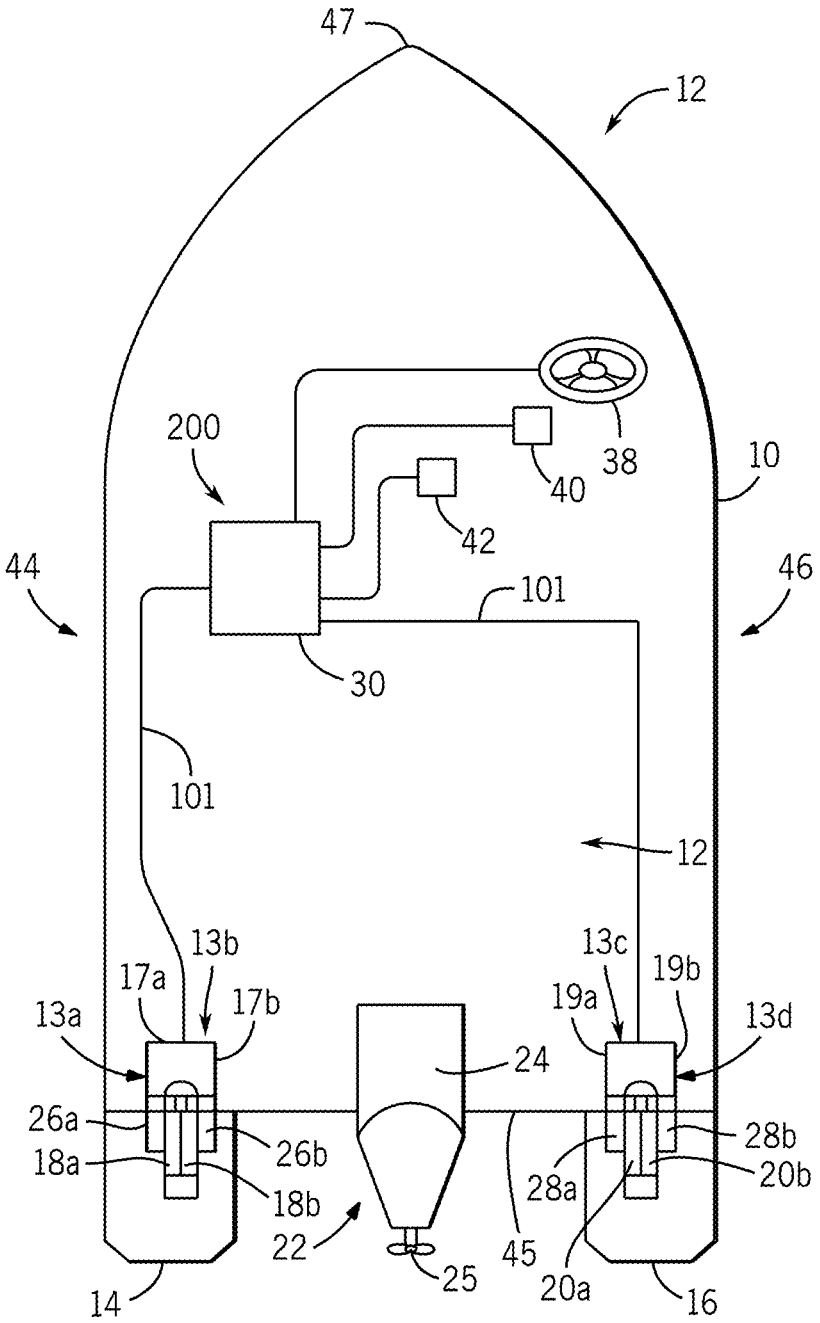
FIG. 1 illustrates a marine vessel with an exemplary actuation system according to one embodiment of the present disclosure.

In the present description, certain terms have been used for brevity, clarity and understanding. No unnecessary limitations are to be inferred therefrom beyond the requirement of the prior art because such terms are used for descriptive purposes only and are intended to be broadly construed.

Actuators are used on marine vessel for various purpose and for moving various devices. For example, actuators may be configured to control trim tab position, control trim position of a trimmable marine drive or other trimmable device, control steering position of a steerable marine drive or other steerable device (such as a rudder). Alternatively or additionally, one or more actuators may be configured to deploy and retract a thruster or trolling motor. Alternatively or additionally, actuators may be provided to control the position of a hatch or enclosure access point, such as on a cowling of a marine drive as described in U.S. Pat. No. 11,780,549. Alternatively or additionally, one or more actuators may be a seat actuator configured to lift and lower a seat (such as at the helm) or to move the seat fore and aft. In still other embodiments, the plurality of actuators on the vessel may include one or more actuators for moving an accessory, such as a sun shade. When multiple actuators are provided on a vessel and are configured to communicate on a single communication network or line, the actuators need to be configured so that the control system can identify the location, and thus purpose, of the actuator. For example, controller access network (CAN) based actuators are connected with a controller through an addressing process (which may be automatic with communication protocols such as NMEA2K) and a location identification process, wherein a location is input into the controller, often by a user with service tools. The service tool can place the controller in a configuration state, wherein the controller prompts the user to perform an action that will identify the actuators, sometimes by using position sensors connected to or associated with the actuator.

In actuator arrangements regarded herein, two actuators are paired together to actuate a single actuated device. Thus, the actuators communicating on the communication network include one or more pairs of actuators that cooperate to jointly move an actuated device, such as a trim tab, a steerable marine drive, or a trimmable marine drive. In arrangements regarded herein, the paired actuators are configured such that the actuated device does not move unless both actuators in the pair of actuators receive a movement command.

The inventors developed the disclosed tab actuation method and control system configured to automatically identify which actuators, out of a plurality of actuators communicating on a network, are paired together. The disclosed actuation systems and methods are configured to automatically determine the location of each of at least three actuators communicating on a communication network based on the position information measured in response to movement commands. The controller assigns an actuator location to each of the at least three actuators based on position information measured by a plurality of position sensors in response to the movement commands. Namely, if a threshold movement of a commanded one of the at least three actuators is detected or a threshold movement of the actuated device is detected, then the actuator location is determined based on the measured movement. For example, if the threshold movement is detected in response to a movement command sent to just two actuators out of the plurality of actuators, then the two selected actuators are identified as an actuator pair. If no movement is detected, then the two selected actuators are determined not to be a pair and the controller repeats the same process with each actuator out of the plurality of actuators until a pair is identified. Through this process, the controller automatically determines the locations of the actuators.

FIG. 1 illustrates a marine vessel 10 having a vessel control system 12 for controlling an attitude and/or propulsion of the marine vessel 10. The present disclosure provides for a vessel control system 12 having first and second trim tabs 14, 16 and comprising an actuation system 200 configured to control a plurality of actuators 13*a*-13*n* (also see FIG. 5) on the vessel 10, including the actuators associated with each of the trim tabs 13*a*-13*d*. The vessel control system 12 comprises an actuation system 200 that includes first and second pairs of trim tab actuators 13*a* and 13*b*, 13*c* and 13*d* in signal communication with the controller 30 that actuate the first and second trim tabs 14, 16 to first and second deployments.

Although in the example shown the trim tab 14 is a port trim tab and the trim tab 16 is a starboard trim tab, the orientation of the trim tabs 14, 16 and their designation as first and second need not correspond. In other words, the port trim tab need not be the first trim tab, and the starboard trim tab need not be the second trim tab, i.e., the designations as "first" and "second" could be reversed. The first trim tab 14 is actuated by a pair of trim tab actuators 13*a*, 13*b* and the second trim tab 16 is actuated by a pair of trim tab actuators 13*c*, 13*d*. Marine vessel 10 includes a marine drive 22, which may be, for example, a pod drive, inboard drive, or other type of stern drive. The marine drive 22 may be trimmable and/or steerable. The marine drive 22 has a powerhead 24, such as an engine or an electric motor, that turns a propeller 25 to produce a thrust to propel the marine vessel 10 in a generally forward direction. The marine drive 22 is capable of rotating around a generally vertical axis in response to commands from a steering wheel 38 or autopilot section 40 of the vessel control system 12. In some embodiments, the system may include actuators 13*a*-13*n* that comprise part of the actuation system 200 that actuate trim and steering and may be configured using the methods described herein. In some configurations of such embodiments, steering and/or trim may each be controlled by a pair of actuators, and in such a configuration would be identified as a pair of actuators according to the methods and functions described herein.

The vessel control system 12 further includes a controller 30. The controller 30 has a memory and a programmable processor. As is conventional, the processor can be communicatively connected to a computer readable medium that includes volatile or nonvolatile memory upon which computer readable code is stored. The processor can access the computer readable code and the computer readable medium upon executing the code carries out the functions as described herein. The controller 30 is connected to trim tab actuators 13*a*, 13*b*, 13*c*, 13*d* and the trim position sensors 26*a*-*b* and 28*a*-*b* via communication network 101, which may be a wired network such as a CAN bus or a wireless network.

Trim tabs 14 and 16 are connected to the transom 45 of the marine vessel 10. These trim tabs 14 and 16 are designed to pivot. To put the bow 47 of the marine vessel 10 down, both trim tabs 14 and 16 are moved down to the maximum lowered position, or "trimmed-in" position. For low power or trailing operation, the trim tabs 14 and 16 are lifted to the maximum raised position, or "trimmed-out" position or zero degree position.

The actuation system 200 includes a plurality of actuators 13*a*-13*n*, which in the depicted embodiment includes first and second pairs of trim tab actuators 13*a* and 13*b*, 13*c* and 13*d*. Each actuator is configured to move an actuated device, which may be any type of actuator such as a hydraulic actuator or a linear electric actuator, such as the linear actuator described in U.S. application Ser. No. 17/716,542, which is hereby incorporated by reference in its entirety. Here, the pairs of actuators are configured to jointly move the actuated device being trim tabs 14 and 16, respectively. U.S. application Ser. No. 18/479,329 describes an exemplary trim tab actuator assembly employing a pair of actuators. In a hydraulic actuator arrangement, the first pair of actuators 13*a*, 13*b* may each comprise a hydraulic cylinder 18*a*, 18*b* connected to an electro-hydraulic motor or pump 17*a*, 17*b*. The hydraulic cylinders 18*a*, 18*b* operate to rotate the first trim tab 14 to the trimmed-out or zero degree position and the trimmed-in position and to maintain the trim tab 14 in any desired position. Similarly, the second pair of actuators 13*c*, 13*d* may each comprise a hydraulic cylinder 20*a*, 20*b* connected to an electro-hydraulic motor or pump 19*a*, 19*b*. The hydraulic cylinder 20*a*, 20*b* operates to rotate the second trim tab 16 to the trimmed-out or zero-degree position and the trimmed-in position and to maintain the trim tab 16 in any desired position. Other types of hydraulic, electric, or electric over hydraulic actuators be used and are contemplated within the scope of the present disclosure.

Figure 2:
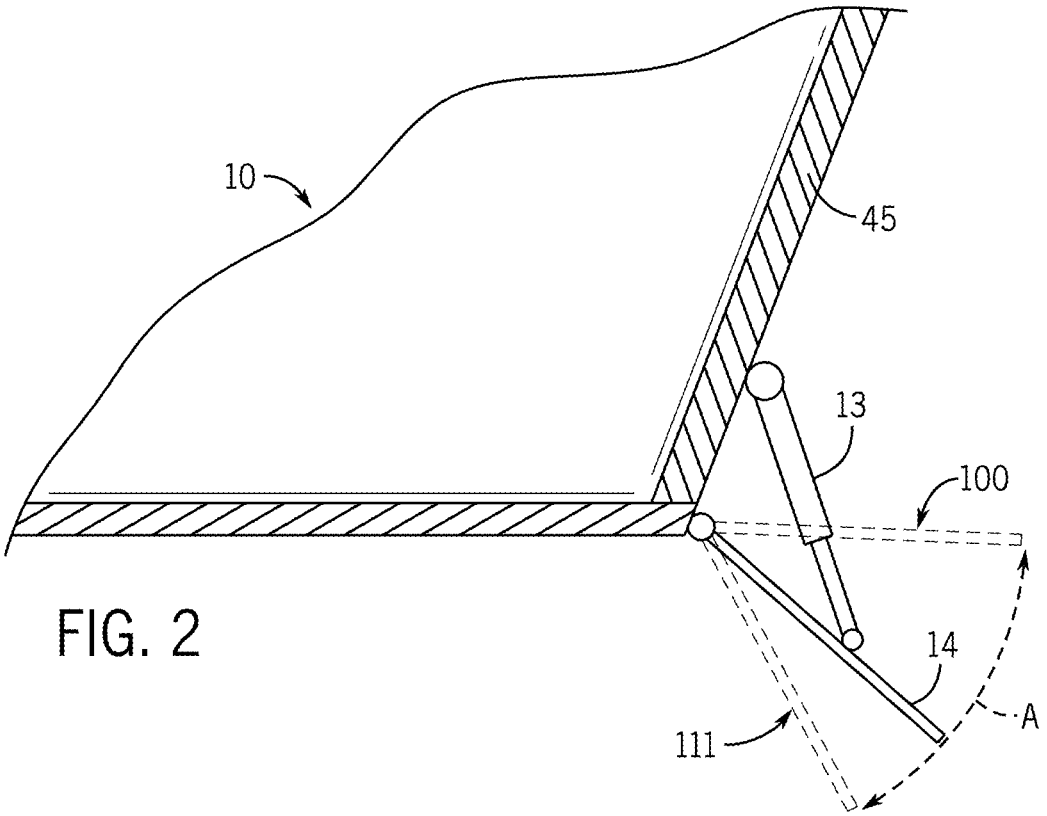
FIG. 2 illustrates a side view of a trim tab and various positions to which the trim tab may be actuated.

Thus, the controller 30 is configured to control movement of the trim tabs 14 and 16 via a pair of actuators 13*a* and 13*b*, 13*c* and 13*d* for each, respectively, by sending a movement command to each actuator in the pair of actuators 13*a* and 13*b*, 13*c* and 13*d* at the same time. In one embodiment, the pair of actuators 13*a* and 13*b*, 13*c* and 13*d* is configured such that the first actuated device does not move unless both actuators 13*a* and 13*b*, 13*c* and 13*d* in the pair of actuators receive a movement command. Thus, each actuator 13*a*, 13*b*, 13*c*, 13*c* may be configured to hold position and prevent movement when no movement command is received, such as to prevent passive movement of the actuator (e.g., back driving) when not activated in response to a movement command. Those having ordinary skill in the art will appreciate that the trim tabs 14 and 16 can be actuated to different deployments with respect to the transom 45 of the marine vessel 10. With reference to FIG. 2, for example, the trim tabs 14, 16 can be deployed from 0% deployment where they project generally horizontally (position 100), to 100% deployment, where they lie at a calibrated maximum angle A with respect to horizontal (position 111). The calibrated maximum angle A at which the trim tabs 14, 16 are considered 100% deployed can vary based on the specifics of the marine vessel 10 to which the trim tabs 14, 16 are attached. In accordance with the nomenclature provided herein, the trim tabs 14, 16 are less deployed when they lie closer to horizontal (position 100) and are more deployed when they extend at increasingly greater angles to horizontal.

Figure 3:
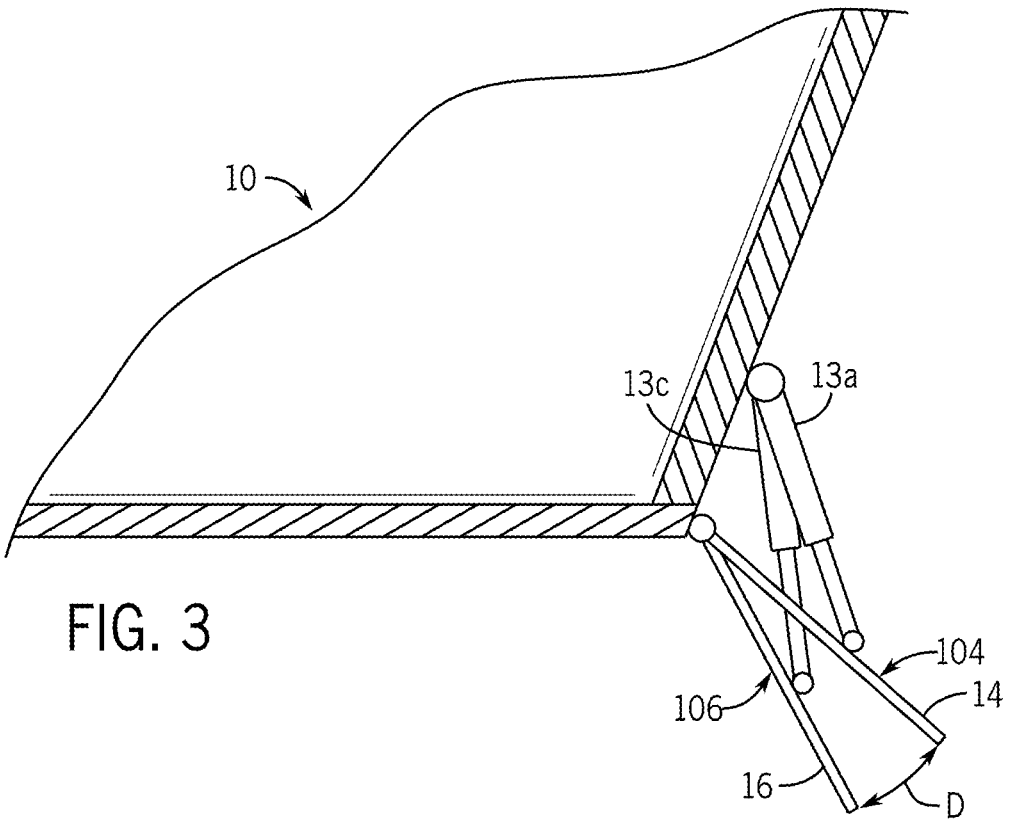
FIG. 3 illustrates a side view of first and second trim tabs according to one embodiment of the present disclosure.

At times, it is desirable to deploy one of the trim tabs 14, 16 more or less than the other of the trim tabs 14, 16 to affect an attitude of the marine vessel 10. In doing so, the trim tabs 14, 16 will have a "differential" in their deployments, in that one of the trim tabs will be deployed at a value from 0 to 100% that is different than the value of deployment (from 0 to 100%) of the other of the trim tabs. For example, referring to FIG. 3, trim tab 14 might be at position 104, while trim tab 16 might be at position 106, creating a differential deployment of D. This differential deployment D can, for example, be quantified in terms of a percent deployment difference or as an angular difference, it being understood that the units by which deployment is measured are not limiting on the scope of the present disclosure. Differential deployment of the trim tabs 14, 16 may be desirable if, for example, a strong wind is blowing from the port side 44 of the marine vessel 10, causing the marine vessel to list to starboard 46. FIGS. 2 and 3 show a side view of the trim tab and actuator arrangement, and thus only one actuator 13*a*, 13*c* is visible controlling the trim tab 14, 16, but it will be understood that each trim tab 14, 16 has a pair of actuators 13*a* and 13*b*, 13*c* and 13*d* configured to jointly move the respective trim tab 14, 16.

Figure 4:
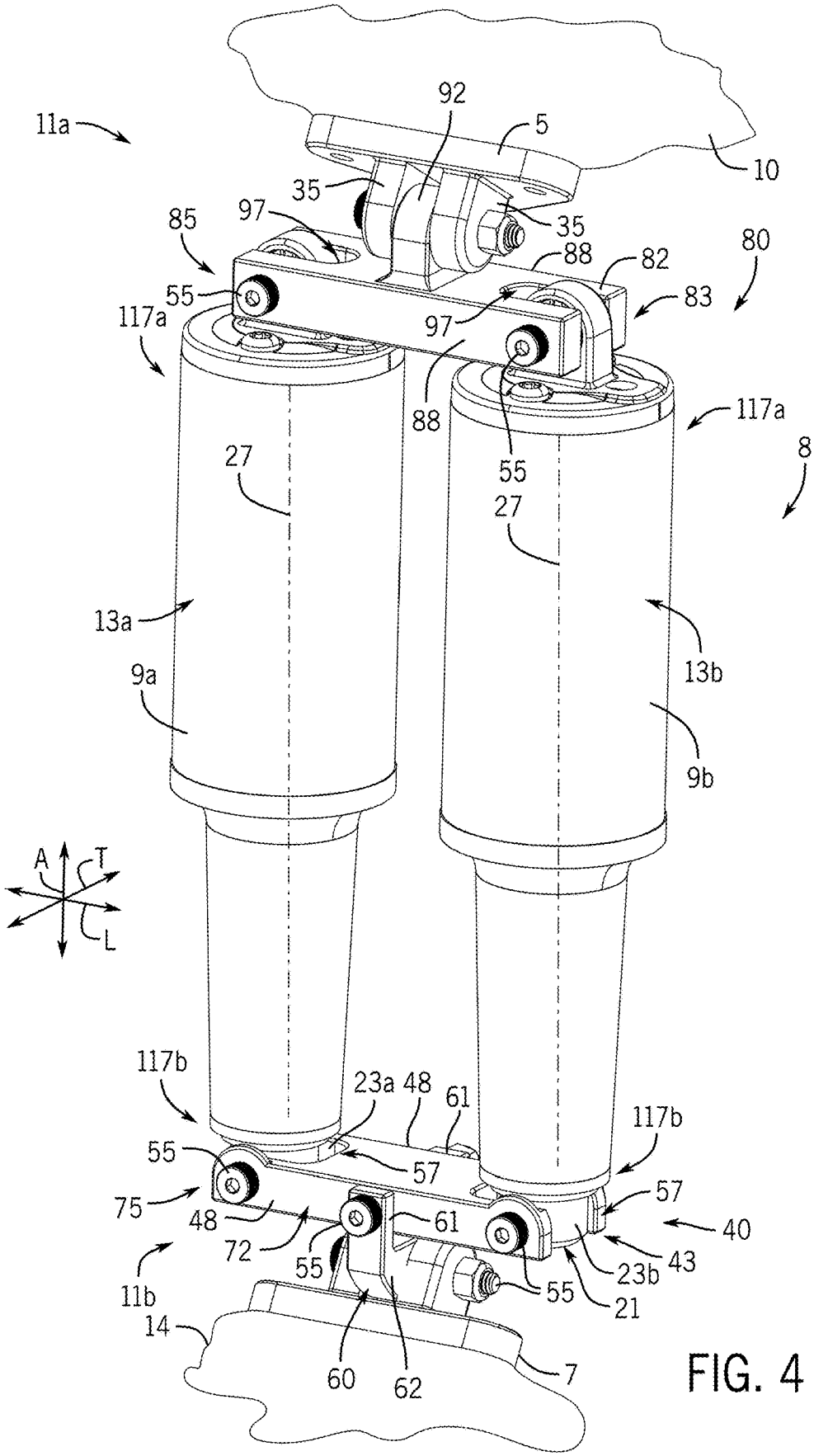
FIG. 4 is a perspective view of an example dual actuator assembly according to one embodiment of the present disclosure.

FIG. 4 depicts a perspective view of an example actuator assembly 8 comprising a pair of actuators 13*a*, 13*b* according to the present disclosure. The actuator assembly 8 is shown here as effectuating movement of a trim tab 14. In other embodiments, the actuator assembly 8 may be configured to actuate movement of a trimmable marine drive or to actuate steering movement of a steerable marine drive. The actuator assembly 8 generally has a top first end 11*a* configured to be coupled to a hull or transom of a marine vessel 10 (a portion of which is schematically depicted in FIG. 4) and an opposite bottom second end 11*b* configured to be coupled to a trim tab 14 (a portion of which is schematically depicted in FIG. 4). The trim tab 14 is pivotally coupled to the hull or transom of the marine vessel 10 via a hinge (not depicted). In operation, the actuator assembly 8 actuates to pivot the trim tab 14 relative to the transom or hull of the marine vessel 10 into the water stream created as the marine vessel moves through water to vary the hydrodynamic forces acting on the marine vessel 10. The operator of the marine vessel 10 may desire to vary the hydrodynamic forces to change steering/turning conditions of the marine vessel 10 and/or generate a desired wake behind the marine vessel 10.

The actuator assembly 8 includes at least two or more actuators 13*a*, 13*b* (e.g., linear actuators) that are pivotably coupled between opposing brackets, namely a lower first bracket 70 and an upper second bracket 80 (described in greater detail hereinbelow). Note that while the example actuator assemblies 8 described herein below describe the first bracket 70 coupling the actuator assembly 8 to the trim tab 14 and the second bracket 80 coupling the actuator assembly 8 to the marine vessel 10, in other examples the first bracket 70 couples the actuator assembly 8 to the marine vessel 10 and the second bracket 80 couples the actuator assembly 8 to the trim tab 14. Further note that while the example actuator assemblies 8 and/or brackets 70, 80 are described herein with reference to trim tabs 6, the actuator assemblies 8 and/or brackets 70, 80 of the present disclosure can be utilized with other components of the marine vessel 10, such as hatch lifts, seating tables, side panels of the marine vessel, a trimmable marine drive (such as a trimmable outboard drive or trimmable stern drive), a steerable marine drive (such as a steerable outboard drive or steerable stern drive), a jack plate, windows, windshield vents, and the like.

The actuators 13*a*, 13*b* have a generally parallel orientation with respect to each other. Each actuator 13*a*, 13*b* has a housing 9*a*, 9*b* with a first housing end 117*a* and an opposite second housing end 117*b* and a rod 23*a*, 23*b*. The rod 23*a*, 23*b* extends from the second housing end 117*b* and is actuatable to extend from and retract into the housing 9*a*, 9*b* along a rod axis 27 in any suitable manner known in the art. In one example, the actuator 13*a*, 13*b* is an electric linear actuator having a motor, gearset, and spindle, which together work to extend the rod 23*a*, 23*b* out of the housing 9*a*, 9*b* or retract the rod 23*a*, 23*b* into the housing 9*a*, 9*b* in response to commands from a controller 30. Optionally, the actuator assembly 8 includes a cover (not depicted) that covers and protects the actuators 13*a*, 13*b* from damage.

In operation, the rod 23*a*, 23*b* extends from the housing 9*a*, 9*b* to pivot the trim tab 14 away from the marine vessel 10. The rod 23*a*, 23*b* retracts into the housing 9*a*, 9*b* to pivot the trim tab 14 toward the marine vessel 10. Note that while it is possible for a single actuator 13*a*, 13*b* to be utilized to pivot the trim tab 14, the present inventors, through research and observations, recognized that utilizing two or more actuators 13*a* and 13*b* provides unique advantages in comparison to assemblies with only one actuator. For example, utilizing two actuators 13*a*, 13*b* increases the total force that may be applied by the actuators 13*a* and 13*b* to pivot the trim tab 14. In other examples, utilizing two less-powerful actuators 13*a*, 13*b* may be more cost-effective than utilizing one relatively more-powerful actuator. In still other examples, using two relatively smaller actuators 13*a*, 13*b* occupies less space and/or is lighter than utilizing one relatively larger actuator that occupies a large amount of space and/or is heavier.

The example first bracket 70 includes a main body 72 having a first end 43 and an opposite second end 75. The first bracket 70 generally extends longitudinally between the ends 43, 75 (see example axis L) and laterally between opposing sides 48 (see example axis T). The main body 72 defines cutouts 57 at each end 43, 75 such that the ends 43, 75 are forked ends. A fastener 55 (e.g., rod and cotter pin, threaded rod with bolt) is removably inserted into the bore along the first main axis to couple the main body 72 to a linking member 60 of the first bracket 70, as will be described further herein below. Fasteners 55 are also removably inserted into the bores at the ends 43, 75 of the main body 72 along the respective axes to couple the actuators 13*a* and 13*b* to the main body 72 of the first bracket 70. Specifically, the fasteners 55 couple the rod end 21 of each rod 23*a*, 23*b* to the ends 43, 75, respectively. As such, the rods 23*a*, 23*b* (and thus the actuators 13*a* and 13*b*) and the main body 72 pivot relative to each other about the end axes.

As noted, the first bracket 70 includes a linking member 60, which is coupled to the main body 72 with a fastener 55. The linking member 60 can be any suitable component, such as a clevis. The linking member 60 has an arm 61 adjacent to each side 48 of the main body 72 and a body portion 62 from which the arms 61 extend. The linking member 60 and the main body 72 pivot relative to each other about the first main axis.

A bore in the body portion 62 of the linking member 60 longitudinally extends along a linking axis. A fastener 55 (e.g., rod and cotter pin, threaded rod with bolt) pivotally couples the linking member 60 to a mounting bracket 7, which is in turn attached to the trim tab 14. The mounting bracket 7 includes a pair of cars with bores therein (depicted in dashed lines in FIG. 2) through which the fastener 55 is received. As such, the linking member 60 and the mounting bracket 7 (and thus the trim tab 14) pivot relative to each other about the linking axis. Note that in other examples, the mounting bracket 7 may be part of the first bracket 70. In these examples, the mounting bracket 7 is coupled to the trim tab 14 in any known manner, such as by fasteners including screws, adhesives, or the like.

A tab 92 extends from the main body 82 of the second bracket 80 and defines a bore longitudinally extending along a tab axis. The tab 92 is fixed relative to the main body 82. A fastener 55 (e.g., rod and cotter pin, threaded rod with bolt) pivotally couples the tab 92 to a mounting bracket 5, which is in turn attached to the marine vessel 10. The mounting bracket 5 includes a pair of cars 35 with bores therein through which the fastener 55 is received. As such, the main body 82 pivots relative to the mounting bracket 5 (and thus the marine vessel 10) about the tab axis. Note that in some embodiments, the mounting bracket 5 is part of the second bracket 80. In these examples, the mounting bracket 5 is coupled to the marine vessel 10 in any known manner, such as by fasteners including screws, adhesives, or the like.

Figure 5:
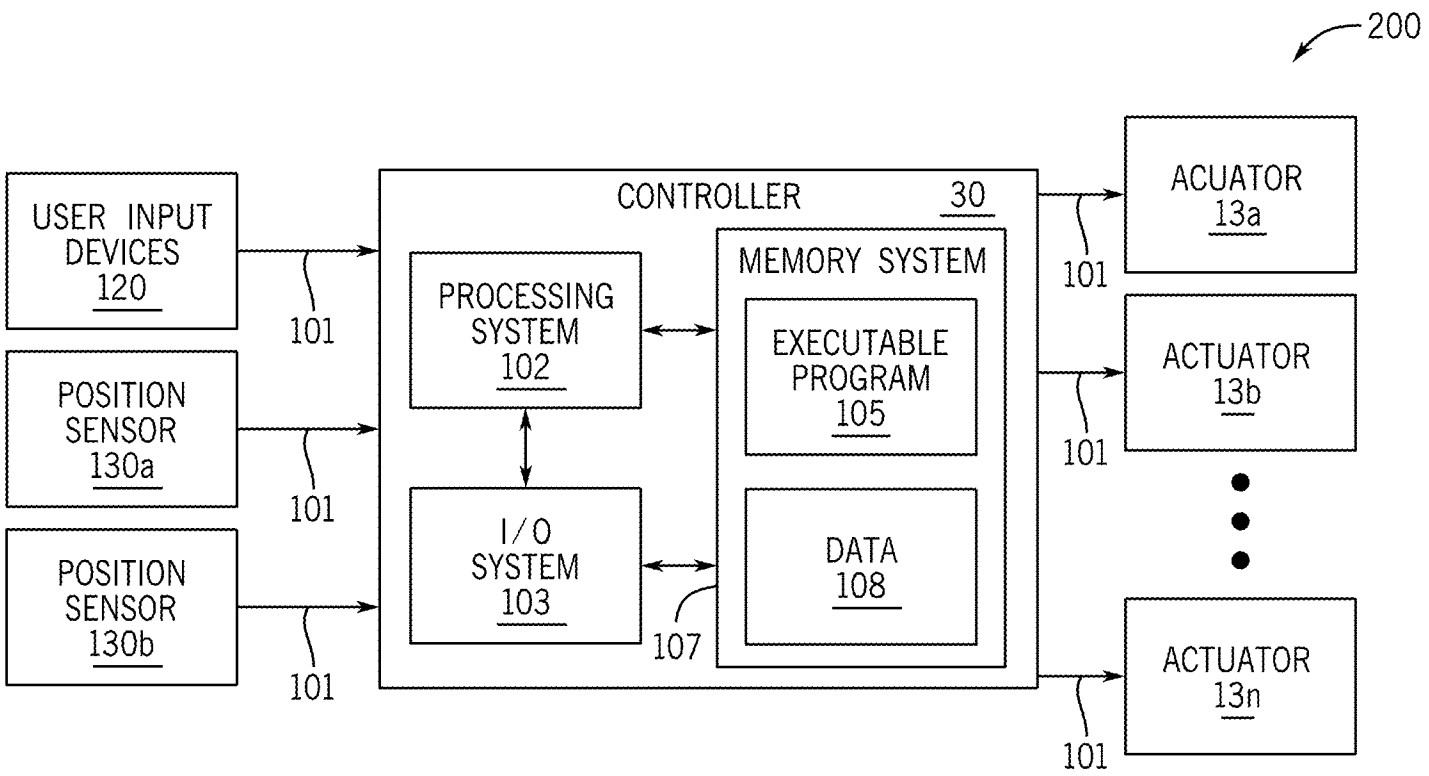
FIG. 5 is an example actuator system for a marine vessel according to the present disclosure.

FIG. 5 depicts an exemplary actuation system 200 comprising a controller 30 for controlling the plurality of actuators 13*a*-13*n*. The controller 30 is in communication with the actuators 13*a*-13*n* and is configured to control operation of the actuators 13*a*-13*n*, e.g., to extend and retract the rods 23*a*, 23*b* relative to their corresponding housings 9*a*, 9*b* by providing a predetermined current and voltage to a motor of the actuator for a predetermined period of time. More specifically, the controller 30 can be configured to control a speed and a direction of actuation, such as to generate movement commands to execute a configuration routine as described herein.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, and may be direct or indirect, and may follow alternate pathways.

In certain examples, the controller 30 communicates with each of the components of the marine vessel 10 and/or plurality of actuators 13*a*-13*n* via a communication network 101, which can be any wired or wireless link. The controller 30 is capable of receiving information and/or controlling one or more operational characteristics of the actuators 13*a*-13*n* and by sending and receiving control signals via the communication network 101. In one example, the communication network 101 is a controller area network (CAN) bus; however, other types of communication networks or links, including wireless networks, could be used.

It will be recognized that the extent of connections and the communication networks 101 may be one or more shared connections, or links, among some or all of the components of the marine vessel 10 and/or the actuators 13*a*-13*n*. Moreover, the communication network 101 lines are meant only to demonstrate that the various control elements are capable of communicating with one another, and do not represent actual wiring connections between the various elements, nor do they represent the only paths of communication between the elements. Additionally, the marine vessel 10 and/or the actuators 13*a*-13*n* may incorporate various types of communication devices and systems, and thus the illustrated communication networks 101 may in fact represent various types of wireless and/or wired data communication systems.

The controller 30 may be a computing system that includes a processing system 102, memory system 107, and input/output (I/O) system 103 for communicating with other devices, such as input devices (e.g., position sensors 130*a*, 130*b*, speed sensors, user input device 120) and output devices (e.g., the actuators 13), either of which systems 102, 107 may also or alternatively be stored in a cloud. The processing system 102 loads and executes an executable program 105 from the memory system 107, accesses data 108 stored within the memory system 107, and directs the marine vessel 10 and/or the actuators 13*a*-13*n* to operate as described in further detail below.

The processing system 102 may be implemented as a single microprocessor or other circuitry, or may be distributed across multiple processing devices or sub-systems that cooperate to execute the executable program 105 from the memory system 107. Non-limiting examples of the processing system include general purpose central processing units, application specific processors, and logic devices.

The memory system 107 may comprise any storage media readable by the processing system 102 and capable of storing the executable program 105 and/or data 108. The memory system 107 may be implemented as a single storage device or may be distributed across multiple storage devices or sub-systems that cooperate to store computer-readable instructions, data structures, program modules, or other data. The memory system 107 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

During operation of the marine vessel 10, the controller 30 is configured to send movement command signals (e.g., electric control signals) to the actuators 13*a* and 13*b* to thereby cause the actuator assembly 8 to pivot the trim tab 14 (see FIGS. 1-4) up and down with respect to the water surface. The actuators 13*a* and 13*b* can also be configured to hold a position when no movement command signals are received from the controller 30.

In the example of providing a command via a user input device 120, the user input device 120 (such as trim control buttons) sends an actuation signal to the controller 30, which in turn controls operation of the actuators 13*a* and 13*b*. The user input device 120 is any device capable of receiving an input from the operator of the marine vessel 10, and in certain examples, the user input device 120 includes one or more levers, joysticks, switches, buttons, sliders, keys, touch screens, and/or the like. In certain examples, the user input device 120 may be a pair of buttons, switches, or keys. Typically, a given button, switch, or the like corresponds to a given trim tab 14, of which there are typically two on the marine vessel 10. A user may input a "trim up" command via the user input device 120, in response to which the controller 30 provides power to the actuators 13*a*, 13*b* to retract the rods 23*a*, 23*b* into the housings 9*a*, 9*b*. The user may input a "trim down" command via the user input device 120, in response to which the controller 30 provides power to the actuators 13*a*, 13*b* to extend the rods 23*a*, 23*b* from the housings 9*a*, 9*b*.

As noted herein, the controller 30 is further configured to control the actuators 13*a*-13*n* to execute a configuration routine to configure the plurality of actuators 13*a*-13*n*.

A plurality of position sensors 130*a*, 130*b* sense the position of the plurality of actuators or of the actuated devices. Here the plurality of position sensors 130*a*, 130*b* is represented as two position sensors, but in other embodiments may include any number of additional position sensors 130 depending on the number of actuators 13*n* and/or actuated devices in the actuation system 200. The position sensors 130*a*, 130*b* may each be associated with a respective actuator 13*a*, 13*b*. For example, referring again to FIG. 4, the first position sensor 130*a* may be configured to sense a position of the first rod 23*a* and the second position sensor 130*b* may be configured to sense a position of the second rod 23*b*, and the controller 30 is configured to independently control movement of the first rod 23*a* and the second rod 23*b*.

In other examples, rather than measuring or calculating the position of the rod 23*a*, 23*b* with respect to the housing 9*a*, 9*b*, the controller 30 is provided with information related to the position of the trim tab 14 with respect to the transom of the marine vessel 10. To that end, a plurality of position sensors 130*a*, 130*b* may be trim sensors, which is a position sensor configured to measure the position of the actuated device such as the trim tab (also known in the art as a "trim sender"), where a trim sensor may be provided on each trim tab to sense the position of the trim tab 14. In one example, the trim sensor is a Hall Effect sensor that measures the rotational position of the trim tab 14 with respect to the transom of the marine vessel 10.

As described herein, adjustment of the actuators 13*a*, 13*b* is used to automatically execute a control routine to configure the actuation system 200 to determine which actuators 13*a*-13*n* are paired. An actuation system 200 for moving at least one device on a marine vessel, such as a trim tab, includes at least three actuators 13*a*-13*n* wherein the at least three actuators 13*a*-13*n* includes at least one pair of actuators configured to jointly move a first actuated device. The actuation system may interface with a plurality of actuated devices, such as a trim tab, a steerable marine drive, and/or a trimmable marine drive, some or all of which may be controlled by actuator pairs.

The locations of the at least three actuators 13*a*, 13*b* are initially unknown by the controller, which may be determined automatically as described herein. A plurality of position sensors are configured to generate position information indicating whether each one of the at least three actuators 13*a*-13*n*—has moved and/or whether the first actuated device (e.g., trim tab 14, 16) has moved. In one embodiment, the plurality of position sensors 130*a*, 130*b* include a position sensor associated with each of the actuators 13*a*-13*n* and configured to generate position information indicating whether a respective one of the at least three actuators 13*a*-13*n* is moved by at least a threshold actuator movement in response to a movement command by the controller 30. Alternatively or additionally, the plurality of position sensors 130*a*, 130*b* include a position sensor associated with each of the actuated devices (e.g., trim tabs 14, 16) and configured to generate position information indicating whether a respective one of the actuated devices is moved by at least a threshold device movement in response to a movement command by the controller 30. If the thresholds for the threshold actuator movement and/or a threshold device movement is exceeded, then an actuator pair has been located. In embodiments where one or more of the positions sensors 130*a*, 130*b* are associated with one or more of the actuated devices (e.g., trim tabs 14, 16), then the location of the paired actuators can also be determined.

In another embodiment, when there are two or more actuated devices, there are at least four actuators 13*a*, 13*b*, 13*c*, 13*d* which comprise at least a first pair of actuators and a second pair of actuators configured to move first and second actuated devices respectively. The first pair of actuators 13*a*, 13*b* is configured to jointly move the first actuated device, wherein the first pair of actuators is configured such that the first actuated device does not move unless both actuators in the first pair of actuators receive a movement command. The second pair of actuators 13*c*, 13*d* is configured to jointly move a second actuated device, wherein the second pair of actuators is configured such that the second actuated device does not move unless both actuators in the second pair of actuators receive the movement command. Thus, where a particular actuator 13*a*, 13*b*, 13*c*, 13*d* is arranged in a pair, the actuated device does not move if only that particular actuator 13*a*, 13*b*, 13*c*, 13*d* receives a movement command. Both actuators 13*a* and 13*b* or 13*c* and 13*d* must receive the movement command for the actuated device 14, 15 to move. The controller 30 automatically determines the pair arrangement of the at least four actuators by determining which of the at least four actuators 13*a*, 13*b*, 13*c*, 13*d* is in the first pair and which of the at least four actuators 13*a*, 13*b*, 13*c*, 13*d* is in the second pair. In embodiments where one or more of the positions sensors 130*a*, 130*b* are associated with one or more of the actuated devices (e.g., trim tabs 14, 16), then the location of the paired actuators can also be determined.

Figure 6:
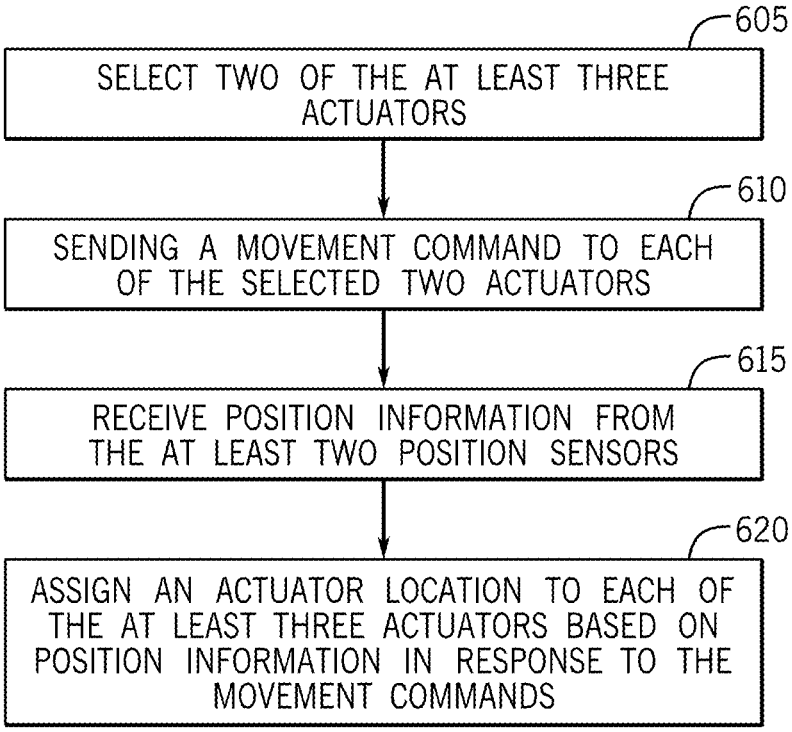
FIGS. 6 and 7 illustrate methods of configuring an actuation system on a marine vessel according to embodiments of the present disclosure.

FIG. 6 illustrates exemplary method steps for configuring an actuation system on a marine vessel, wherein the actuation system comprises at least three actuators arranged in at least one pair of actuators configured to jointly move a first actuated device, wherein locations of the at least three actuators are initially unknown by a controller. Prior to the configuration, the controller 30 may receive a list of actuators 13*a*-13*n* to be configured, such as by receiving communication via the communication network 101 of the actuators 13*a*-13*n* installed on the marine vessel 10 and communication on the network 101. The list of actuators 13*a*-13*n* includes at least three actuators, at least two of which are paired. In some embodiments, the controller 30 may be configured to also receive a pairing arrangement of the plurality of actuators 13*a*-13*n*, as in how many pairs are to be detected.

To begin, two of the plurality of actuators 13*a*-13*n* are selected at step 605. This could be any two actuators, which could be randomly selected or selected based on any criterion, such as based on the order that the actuators report to the controller 30 when they are connected or based on the numerical identification of the actuator, such as selecting the two highest or two lowest numbers. Alternatively, the actuators may be selected based on the position values measured by the corresponding position sensors (where the actuators have an integrated position sensor), such as to select two actuators that have the closest position values as the first two actuators and thereafter select the actuators based on the position values in descending order of closeness. These are just a few examples of means for selecting the two actuators to begin the configuration routine.

At 610, a movement command is sent by the controller to each of the selected two actuators. In some embodiments, it may be desirable to program the controller 20 such that the movement commands sent to the actuators 13*a*-13*n* for the configuration routine are relatively small, to avoid straining the actuators or the actuated device when only one of the actuators in a pair is commanded. For example, the movement command may be 5% of the maximum command magnitude, such as 5% or 10% of the maximum duty cycle or force output of the actuator 13*a*, 13*n*.

Position information is received at step 615 from the plurality of positions sensors 130, 130*b* associated with the actuation system 200. In one embodiment, following the first movement commands, the controller receives first position information from a first position sensor associated with the first actuator and second position information from a second position sensor associated with the second actuator. Alternatively or additionally, the position information may include position information associated with one or more actuated devices.

Movement detection may be identified by comparing the position information to one or more thresholds, such as to a threshold actuator movement and/or a threshold device movement, spending on the position information sensed. The thresholds for the threshold actuator movement and/or a threshold device movement are set based on the magnitude of the movement command and according to the configuration of the actuator and actuated device. Namely, the thresholds are set to detect movement commensurate with the movement command—e.g., an amount of movement about equal to or slightly less than the movement expected if the actuator is fully able to effectuate the movement command. Thereby, the threshold is set to avoid misidentifying minor movement of either the actuators 13*a*, 13*b* or actuated device as being a full response to the movement command.

At 620, an actuator location is assigned by the controller 20 to each of the at least three actuators 13*a*-13*n* based on position information in response to the movement commands. The control system 300 performs a number of selection/movement/measurement iterations The number of iterations depends on the number of actuators 13*a*-13*n* in the actuation system 200 and the pairing arrangement, as well as how quickly the pairs are located (i.e., luck). In the first iteration, the position information is utilized to determine if any of the initial selected two actuators or one of the actuated devices moves. If both the actuator and/or actuated devices move, then an actuator pair is identified. If only one actuator moves and the other does not, then the one that moves is determined to be an unpaired actuator and the actuator that doesn't move is a paired actuator whose pair has not yet been located. The unpaired actuator may be assigned as such and the controller 30 may select another one of the remaining untested actuators 13*a*-13*n* in conjunction with the paired actuator selected in the first round until its pair is located. If neither of the two selected actuators moves, then it is determined that the two are paired, but not with each other. In that case, the controller 30 may maintain one of the initial two actuators and select another one of the remaining untested actuators 13*a*-13*n* until a pair is located. The controller continues accordingly until all actuators 13*a*-13*n* are located.

The actuator location may only include pairing information—i.e., which actuators are paired together. In embodiments where position sensors are associated with the actuated device(s), then the actuator location may include association of each actuator pair with an actuated device, such as associating each actuator pair 13*a* and 13*b*, 13*c* and 13*d* with a respective one of the starboard or port trim tabs 14, 16.

Figure 7:
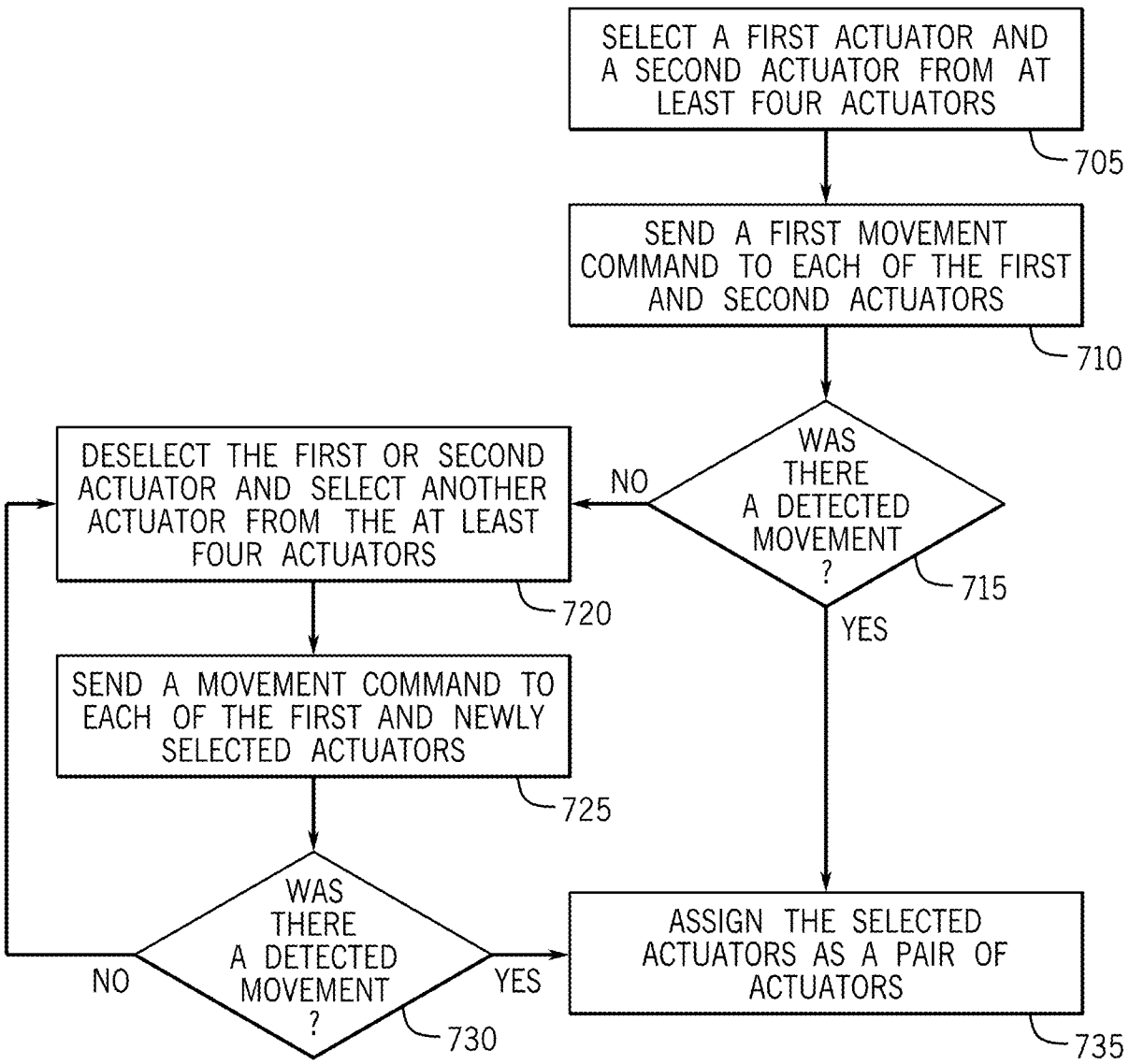

FIG. 7 is a flowchart illustrating exemplary method steps for configuring an actuation system on a marine vessel comprising four actuators arranged in two sets of two, such as two pairs of actuators configured to actuate two trim tabs like the arrangement shown in FIG. 1. At 705, the controller selects a first actuator and a second actuator from the four actuators. At 710, the controller sends a movement command to each of the first and second actuators. At 715, the controller receives movement information from the plurality of position sensors and, based thereon, determines if the first and second actuators and/or the actuated device(s) have moved. The movement may exceed a threshold actuator movement and/or a threshold device movement to be considered as meeting the movement requirement.

If there is no detected movement (e.g., threshold movement), then at 720, the controller deselects either the first or the second selected actuator and selects another actuator from the at least four actuators. The controller then sends another movement command to each of the first and the newly selected actuators. At 730, the controller measures movement of the actuators and/or the actuated device(s) to determined if movement is detected. If movement is not detected, then the controller repeats the process initiated at 720 by deselecting a selected actuator and selecting (and testing) another actuator. If movement is detected at either 715 or 730, then at 735 the selected actuators are assigned by the controller as a pair of actuators.

The controller repeats the steps initiated at 705 to identify and assign all pairs of actuators within the identified actuators.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. An actuation system for moving at least two devices on a marine vessel, the system comprising:

at least three actuators, wherein the at least three actuators include at least one pair of actuators configured to jointly move a first actuated device;

a plurality of position sensors configured to generate position information indicating whether each one of the at least three actuators has moved and/or whether the first actuated device has moved; and a controller configured to control each of the at least three actuators, wherein locations of the at least three actuators are initially unknown by the controller; and wherein the controller is configured to automatically determine the location of each of the at least three actuators on the marine vessel based on the position information measured in response to movement commands and, thereafter, control each of the at least three actuators based on their respective location.

2. The system of claim 1, wherein the first actuated device is a trim tab.

3. The system of claim 1, wherein the first actuated device is a steerable marine drive or a trimmable marine drive.

4. The system of claim 1, wherein the pair of actuators is configured such that the first actuated device does not move unless both actuators in the pair of actuators receive a movement command.

5. The system of claim 1, wherein the controller is configured to:

automatically select two of the at least three actuators;

send a movement command to each of the selected two actuators; and assign an actuator location to each of the at least three actuators based on the position information measured by the plurality of position sensors in response to the movement commands.

6. The system of claim 5, wherein the controller is further configured to:

determine whether at least one of the selected two actuators by at least a threshold actuator movement or the first actuated device moved by at least a threshold device movement in response to the movement command based on the position information; and assign the actuator location to each of the at least three actuators based on whether at least one of the selected two actuators moved by at least the threshold actuator movement and/or the first actuated device moved by at least the threshold device movement in response to the movement command.

7. The system of claim 6, wherein the pair of actuators is configured such that the first actuated device does not move unless both actuators in the pair of actuators receive a movement command.

8. The system of claim 1, further comprising:

at least three position sensors, including a position sensor associated with each of the at least three actuators and configured to generate position information indicating whether a respective one of the at least three actuators moved by at least a threshold actuator movement; and wherein the controller is configured to assign the location to each of the at least three actuators based on which of a selected two actuators moves in response to a movement command.

9. The system of claim 1, further comprising at least four actuators, wherein a first pair of actuators is configured to jointly move the first actuated device and wherein the first pair of actuators is configured such that the first actuated device does not move unless both actuators in the first pair of actuators receive a movement command, and further comprising:

a second pair of actuators configured to jointly move a second actuated device, wherein the second pair of actuators is configured such that the second actuated device does not move unless both actuators in the second pair of actuators receive the movement command;

wherein the controller is configured to automatically determine the location of each of the at least four actuators by determining which of the at least four actuators is in the first pair and which of the at least four actuators is in the second pair.

10. The system of claim 9, wherein the controller is further configured to:

automatically select a first actuator and a second actuator from the at least four actuators;

send a first movement command to each of the first actuator and the second actuator;

following the first movement commands, receive first position information from a first position sensor associated with the first actuator and second position information from a second position sensor associated with the second actuator; and assign an actuator location to each of the at least four actuators based on the first position information and the second position information.

11. The system of claim 10, wherein the controller is configured to assign an actuator location to each of the at least four actuators based on whether neither the first actuator nor the second actuator moved by at least a threshold actuator movement or both the first actuator and the second actuator moved by at least the threshold actuator movement.

12. The system of claim 11, wherein the controller is configured to, in response to determining that neither the first actuator nor the second actuator moved by at least the threshold actuator movement, automatically select a third actuator from the at least four actuators and send a second movement command to each of the first actuator and a third actuator and assign an actuator location to each of the at least four actuators based on the first position information and the second position information measured in response to the second movement command.

13. The system of claim 11, wherein the controller is configured to, in response to determining that both the first actuator and the second actuator moved by at least the threshold actuator movement in response to the movement command, assign the first actuator and the second actuator as being either the first pair of actuators configured to actuate the first actuated device or the second pair of actuators configured to actuate the second actuated device.

14. A method of configuring an actuation system on a marine vessel, wherein the actuation system comprises at least three actuators arranged in at least one pair of actuators configured to jointly move a first actuated device, wherein locations of the at least three actuators are initially unknown by a controller, the method comprising:

the controller automatically determining the locations of the at least three actuators by:

selecting two of the at least three actuators;

sending a movement command to each of the selected two actuators; and assigning an actuator location to each of the at least three actuators based on position information measured by a plurality of position sensors in response to the movement commands.

15. The method of claim 14, wherein assigning the actuator location to each of the at least three actuators includes determining whether at least one of the selected two actuators or the first actuated device moved by at least a threshold device movement in response to the movement command based on the position information measured by a plurality of position sensors.

16. The method of claim 14, wherein the pair of actuators is configured such that the first actuated device does not move unless both actuators in the pair of actuators receive a movement command.

17. The method of claim 14, wherein the first actuated device is a trim tab, a steerable marine drive, or a trimmable marine drive.

18. The method of claim 14, wherein the actuation system further comprises at least four actuators including a first pair of actuators and a second pair of actuators, wherein the first pair of actuators is configured to jointly move the first actuated device and wherein the first pair of actuators is configured such that the first actuated device does not move unless both actuators in the first pair of actuators receive a movement command, and the second pair of actuators configured to jointly move a second actuated device, wherein the second pair of actuators is configured such that the second actuated device does not move unless both actuator in the second pair of actuators receive the movement command, further comprising:

automatically determining, with the controller, the location of each of the at least four actuators by determining which of the at least four actuators is in the first pair and which of the at least four actuators is in the second pair.

19. The method of claim 18, further comprising:

automatically selecting a first actuator and a second actuator from the at least four actuators;

sending a first movement command to each of the first actuator and the second actuator;

following the first movement commands, receiving first position information from a first position sensor associated with the first actuator and second position information from a second position sensor associated with the second actuator; and assigning an actuator location to each of the at least four actuators based on the first position information and the second position information.

20. The method of claim 19, further comprising:

determining whether neither the first actuator moved or both the first actuator and the second actuator moved by at least a threshold actuator movement;

in response to determining that neither the first actuator nor the second actuator moved by at least the threshold actuator movement, automatically selecting a third actuator from the at least four actuators and sending a second movement command to each of the first actuator and a third actuator and assigning an actuator location to each of the at least four actuators based on the first position information and the second position information measured in response to the second movement command; and in response to determining that both the first actuator and the second actuator moved by at least the threshold actuator movement in response to the movement command, assigning the first actuator and the second actuator as being either the first pair of actuators configured to actuate the first actuated device or the second pair of actuators configured to actuate the second actuated device.

* * * * *